United States Patent [19]

Su

[11] Patent Number: 4,732,021

[45] Date of Patent: Mar. 22, 1988

[54] COMBINATION CHANGING MECHANISM FOR THE LOCK OF A LUGGAGE CASE

[76] Inventor: Shuhn C. Su, No. 29, Lu-Hsing Road, Lu-Kang Town, Chuang Hwa Hsieh, Taiwan

[21] Appl. No.: 37,691

[22] Filed: Apr. 13, 1987

[51] Int. Cl.[4] ..... E05B 37/02

[52] U.S. Cl. ..... 70/312; 70/317

[58] Field of Search ..... 70/312, 315, 316, 317, 70/318

[56] References Cited

U.S. PATENT DOCUMENTS

| | | | |
|---|---|---|---|
| 4,343,164 | 8/1982 | Bako | 70/312 |
| 4,354,366 | 10/1982 | Bako | 70/312 |
| 4,532,784 | 8/1985 | Yeh | 70/312 |

*Primary Examiner*—Robert L. Wolfe

*Attorney, Agent, or Firm*—Clifford A. Poff

[57] ABSTRACT

A combination changing mechanism for the lock of a luggage case, primarily characterized in that the operation part for opening the lock is provided in the form of a circular disc. A rotation disc is provided below the operation disc which has a rod extending downwards therefrom into the combination changing mechanism for connection with a lower disc. By this construction, the relationship between the combination dials and the corresponding sleeves can be controlled such that when the operation disc is rotated into its lock-opening position, the combination cannot be changed, when the operation disc is then rotated through 180°, the combination can be changed, and when the operation disc is then rotated through 90°, neither the lock can be opened nor the combination can be changed.

1 Claim, 4 Drawing Figures

COMBINATION CHANGING MECHANISM FOR THE LOCK OF A LUGGAGE CASE

BACKGROUND OF THE INVENTION

General combination locks for luggage cases have combination-changeability. However, in the prior art, the combination of the lock is changed by means of a pushing rod arranged beneath the base of the lock in such a way that sleeves on the shaft can be pushed and disengaged from combination dials by the pushing rod so that the combination dials can rotate freely and thus provide combination-changeability. The locks which are operated in this way are not widely used due to the complexity of the constituent parts, the high cost of manufacture, the disturbance of the combination caused by the contents of the case, and the trouble encountered during the combination changing operation. At present, the generally used locks are primarily characterized in that the pushing seat outside the combination lock can be used for combination changing purpose as long as it is pushed to a position in the same direction beyond the position for opening the lock. By this type of construction, it is more convenient than ever to accomplish the combination changing operation. However, it still has the drawback of combination disturbance caused by inadvertently pushing the seat forward.

SUMMARY OF THE INVENTION

The primary object of the invention is to provide a combination lock for luggage cases in which the combination changing operation cannot be done when the operation disc is rotated to the position for opening the lock. Another object of the invention is to provide a combination lock for luggage cases in which combination changing operation can be done and the lock cannot be opened when the operation disc is rotated through 180° from the lock opening position. A further object of the invention is to provide a combination lock for luggage cases in which neither the lock can be opened nor the combination can be changed when the operation disc is rotated through 90° from the lock opening position.

The combination lock in accordance with the present invention is primarily characterized in that the operation rotatable operation for opening the lock is provided in the form of a circular disc which has a rod extending downwards therefrom. A rotatable operation disc is provided with an offset rectangular groove so that the rod can pass therethrough. The upper portion of the rod is engaged with said rectangular groove so that when an arrow on the operation disc points in a specific direction, the rod of the operation disc can slide within the rectangular groove of the rotation disc for opening the lock if the dials are set to a predetermined combination. When the operation disc is rotated through 180° from the lock opening position, sleeves can be disengaged from the dials so that the combination can be changed; however, in this position, the lock cannot be (right-forwardly) opened because that the rectangular groove in the rotation disc is rotated to the left portion of the rotation disc.

BRIEF DESCRIPTION OF THE DRAWING

These features and advantages of the present invention as well as others will be more fully understood when the following description is read in light of the accompanying drawings in which.

DETAILED DESCRIPTION OF THE PREFERRRED EMBODIMENT OF THE INVENTION

Figure 1:
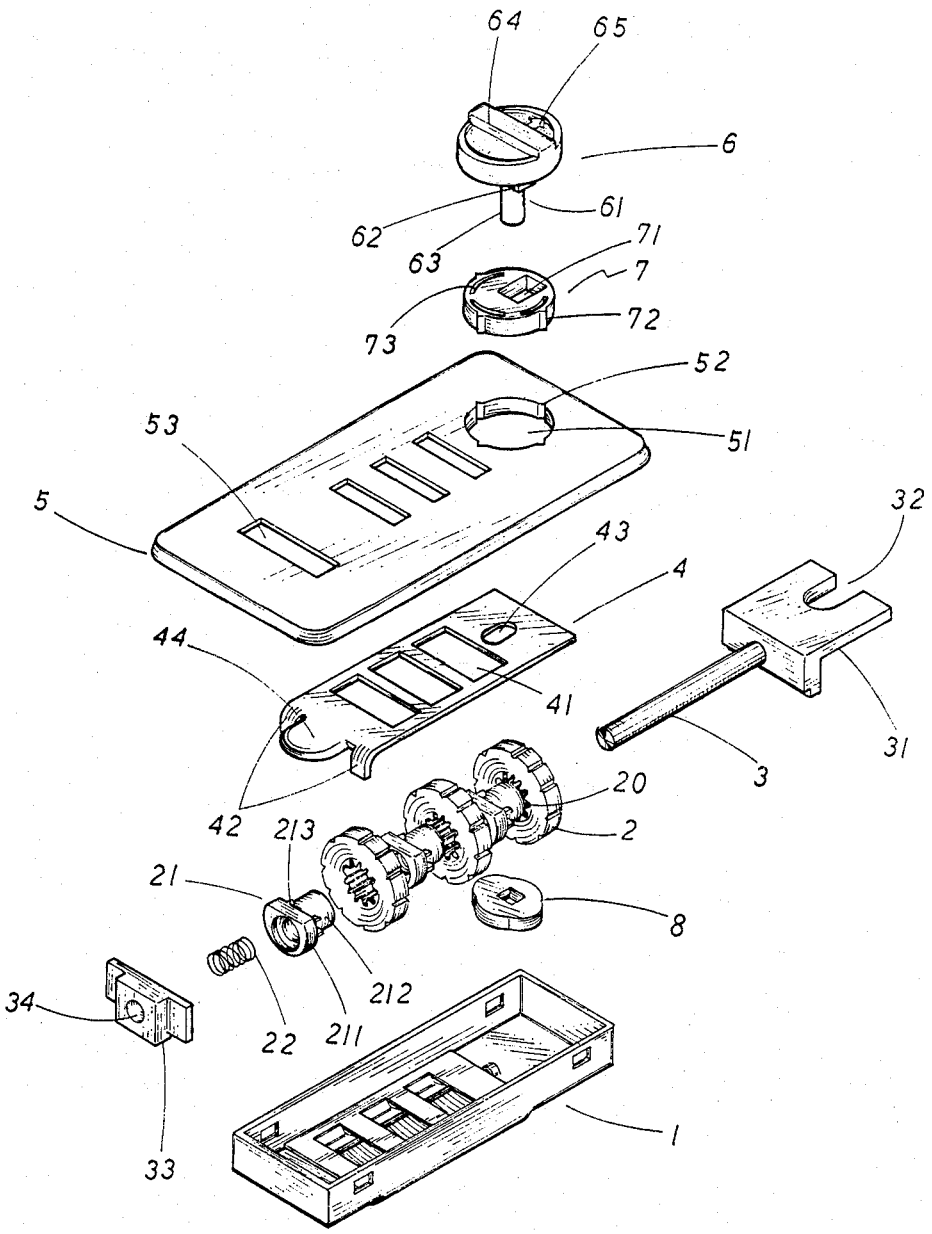
FIG. 1 is an exploded pictorial illustration of a combination lock according to the present invention.
Figure 2:
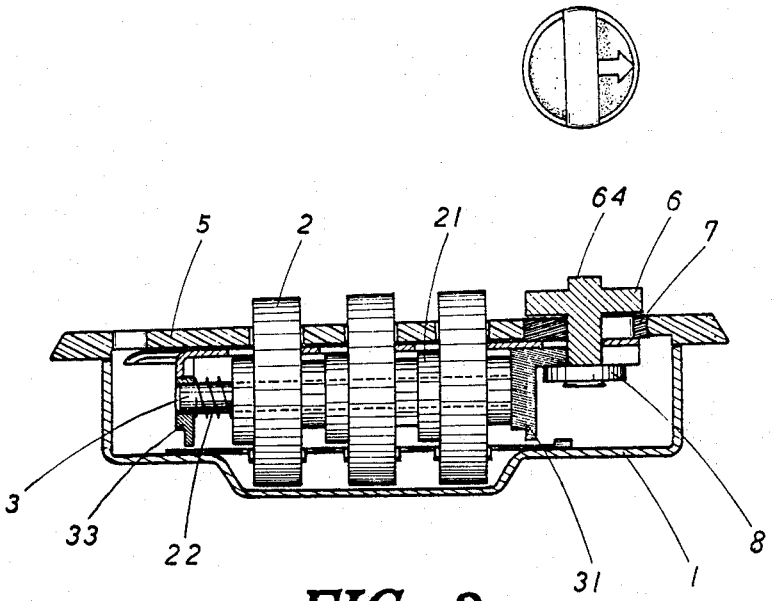
FIG. 2 is a sectional view illustrating the openable opening the combination lock when the indicating arrow on the operation disc thereof is directed to the right.
Figure 3:
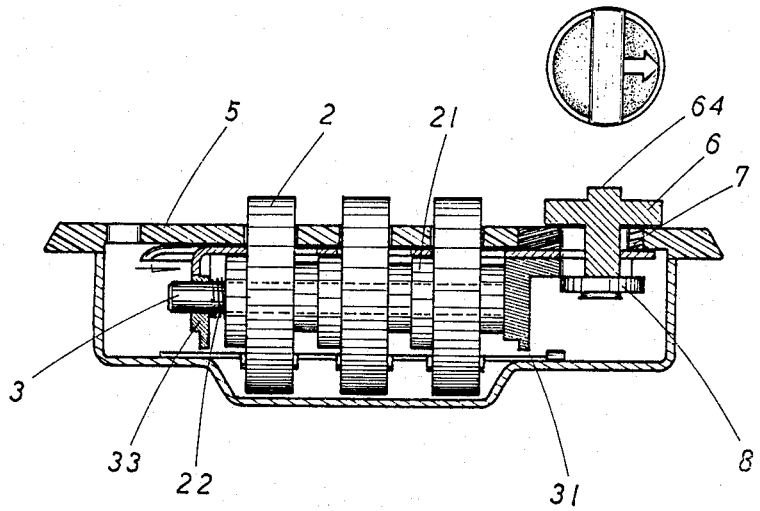
FIG. 3 is a sectional view illustrating the opened status of the combination lock when the indicating arrow on the operation disc thereof is directed to the right.

Referring to FIG. 1, the lock of the present invention includes a base 1 in the form of a case which is substantially open at the top side thereof. Mounted in base 1 are three combination dials 2, three sleeves 21, and a compression spring 22. A shaft 3 passes through every combination dial 2 and sleeve 21. Each dial 2 is internally provided with a plurality of tooth-shaped grooves 20, and numerals are provided on the circumference thereof. Each sleeve 21 has a disc 211 with a flat portion, a collar 212 whose length is larger than the width of the corresponding dial, and a plurality of outer teeth 213 provided on the circumference of the corresponding collar and adjacent to the corresponding disc. The teeth 213 can meshed with the grooves 20 of the corresponding dial. The teeth and grooves can be disengaged when the sleeve is moved to the left, as one views FIGS. 1–3. Shaft 3 is fixed at its right end to a side bracket 31 which has a vertical portion and a horizontal portion, wherein the vertical portion is used for fixedly supporting a shaft 3, and the horizontal portion is formed with an elongate notch 32. The left end of the shaft passes through a vertical left side bracket 33. An aperture is formed in the bracket 33. The left end of the shaft on which compression spring 22 is mounted is insertedly mounted on aperture 34. A displacement plate 4 is mounted above the sleeves and shaft. Displacement plate 4 has three rectangular apertures 41 formed therein. A latch tongue 44 extending to left is provided at the left end of displacement plate 4. Plate 4 also has two claws 42 extending downward for holding the left side of left bracket 33. An elongate aperture 43 is formed at the right portion of displacement plate 4. The elongate aperture 43 is approximately in alignment with an elongate notch 32 in the side bracket 31 but is somewhat offset to the left thereof. A face plate 5 is provided over displacement plate 4 for covering base 1. Three rectangular apertures are formed in face plate 5 at positions corresponding to the rectangular apertures 41 so that a portion of each dial can protrude from face plate 5. Face plate 5 is also provided with a rectangular aperture 53 so that the latching hook of the luggage case can be inserted therein from outside. At the right portion of face plate 5, there is formed a circular aperture 51 in alignment with the elongate aperture 43 of the displacement plate. A plurality of small grooves 52 are formed in the circumference of circular aperture 51. A circular rotation disc 7 is mounted within circular aperture 51. An offset rectangular groove 71 is provided in rotation disc 7 which is integrally formed from suitable material of slight elasticity such as plastics. Rotation disc 7 is also provided on its circumference with a plurality of small projections 72. Inwardly adjacent of each projection 72 there is provided an arcuate internal groove 73 such that the small projections 72 can snap into engagement with small grooves 52 respectively in circular aperture. Moreover, each small projection 72 can be deformed toward the corresponding through groove 73 because of the provision of the latter to avoid wear. An operation disc 6 is provided over rotation disc 7. A raised portion 64 is formed on the operation disc for actuation by fingers. The operation disc is marked thereon with a direction-indicating arrow 65. A rod 61 extends downward from the center of operation disc 6. The upper portion of the rod is formed into a rectangular block 62. The length of the rectangular block is equal to the width of a rectangular groove 71 in rotation disc 7. The lower portion of the rod is formed into a circular cylinder 63. Rod 61 passes through offset rectangular groove 71. The circular cylinder portion of the rod passes through elongate aperture 43 of displacement plate 4 and elongate notch 32 of side bracket 31 such that the lower end of the circular cylinder portion can be secured to a lower disc 8. The foregoing description is directed to the constituent elements and arrangement thereof of the lock in accordnce with the invention. The operation principle of the invention is now described with reference to the accompanying drawings in the following:

Referring to FIGS. 2 and 3, when combination dials 2 are rotated into the on-combination position, the flat portion of each sleeve faces upwards and is in a horizontal position so that displacement plate 4 can be moved leftwards and/or right hand direction. To open the lock, the operation disc must be rotated to a position in which the arrow points to the right. During right-forward movement of rod 61, it is forced to move in rectangular groove 71, and thereby latch tongue 44 of the displacement plate is caused to move in the right hand direction for opening the lock. Meanwhile, the operation disc in this condition can only be moved in the right hand direction and cannot be moved in the left hand direction because the offset elongate groove is in the right half portion of the rotation disc. When the operation disc is moved in the right hand direction, only displacement plate 4 is pulled to move. In the position before and after the opening of the lock, the combination dials 2 can not be inadvertently changed because the sleeves are meshed with the respective combination dials.

Figure 4:
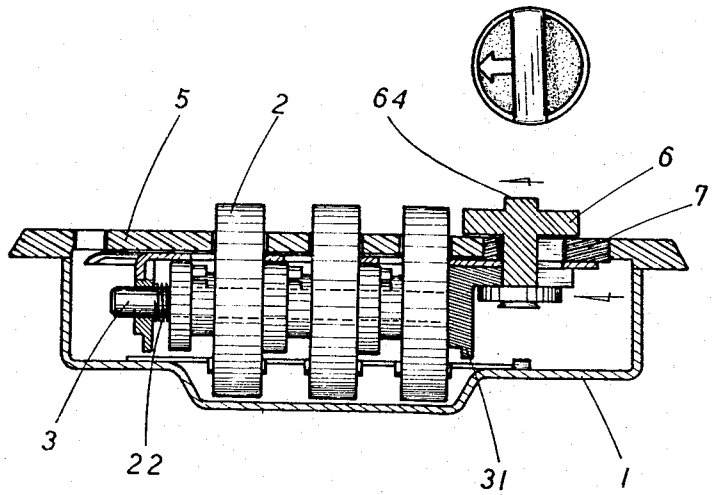
FIG. 4 is a sectional view illustrating the arrangement of parts for changing the combination of the combination lock when the indicating arrow on the operation disc thereof is directed to the left.

Referring now to FIG. 4, during rotation of the operation disc through 180° to the position in which the arrow directs to the left, rod 61 of the operation disc can only be moved leftwards for pushing side bracket 31 to the left and consequently pushing each collar 212 of the corresponding sleeve proturding beyond the right side of the corresponding dial such that each sleeve 21 is moved in the left hand direction to disengage the corresponding dial 2 and thus render each dial 2 freely rotatable for changing the combination as desired. Meanwhile, the operation disc cannot be moved in the right hand direction for opening the lock. Therefore, the combination changing operation can only be done after rotation through 180° of the rotation disc, and thereby the drawbacks of conventional locks can be eliminated. Otherwise, when the rotation disc is rotated 90°, the offset elongate groove is located in the upper or lower half portion of the rotation disc, and consequently the operation disc can be moved neither right nor left. Thus, it can be ensured that, in this state, neither the lock can be opened nor the combination can be changed. It can be appreciated from the foregoing description that the drawbacks of conventional combination locks for luggage cases can be eliminated by use of the invention which is of novelty and utility.

I claim:

1. A combination changing mechanism of a combination lock for a luggage case comprising:

a base which is substantially open at the top side thereof; a plurality of combination dials, wherein each dial being internally provided with a plurality of tooth-shaped grooves and being provided on its circumference with numerals; a plurality of sleeves which have the same number as the dials, each sleeve having a disc with a flat portion, a collar whose length is larger than the width of the corresponding dial, and a plurality of teeth provided on the circumference of the corresponding collar and adjacent to the corresponding disc, wherein each sleeve is mounted in the corresponding dial so that the teeth of the sleeve are meshed with the grooves of the corresponding dial, the sleeve being capable of disengaging from the dial when the sleeve is moved to the left; a compression spring; a shaft which passes through said combination dials, sleeves, and compression spring; a right side bracket which has a vertical portion and a horizontal portion, the vertical portion supporting said shaft at the right end thereof, and the horizontal portion being formed with an elongate notch; a left side bracket comprising a vertical portion in which is provided a circular aperture, wherein the left end of the shaft over which said compression spring is sleeved can be supportedly mounted in said circular aperture of the vertical portion; the combination dials, sleeves, compression spring, and shaft supported between said left side bracket and right side bracket are all mounted within said base; a displacement plate which is mounted above the combination dials, sleeves, and shaft, and has three rectangular apertures formed therein so that a part of each dial can protrude beyound the displacement plate from below through the corresponding rectangular aperture, the left end of said displacement plate being formed with a latch tongue extending to the left and formed with claws extending downward for holding the left side of said left bracket, the right portion of the displacement plate being formed an elongate aperture which is approximately in alignment with said elongate notch of said right bracket but is somewhat offset to the left thereof; a face plate to overlie the displacement plate for covering the base, and wherein the face plate has three rectangular apertures formed at the locations corresponding to those of the rectangular apertures in the displacement plate so that a portion of each dial can protrude therefrom, the face plate being also provided at its left portion with a rectangular aperture so that the latching hook of the luggage case can be inserted therein from outside and being provided at its right portion with a circular aperture in alignment with the elongate aperture of the displacement plate, the circular aperture being provided on its circumference with a plurality of small grooves; a circular rotation disc which is integrally formed from material of slight elasticity and is mounted within the circular aperture at the right portion of the face plate, the circular rotation disc being provided with a rectangular groove therein, having a plurality of small projections provided on its circumference, and being formed with an arcuate through groove inwardly adjacent each of said projection such that said small projections are suitable to rotate in the circular aperture of the face plate and can snap into engagement with the respective small grooves in the circular aperture; an operation disc on which is formed a raised portion for actuation by fingers, the operation disc being marked thereon with a direction-indicating arrow and having a rod extending downward from the center thereof, wherein the upper portion of the rod is formed into a rectangular block, the length of which is equal to the width of the rectangular groove in the rotation disc, and the lower portion of the rod is formed into a circular cylinder, wherein the rectangular block is positioned within the rectangular groove of the rotation disc, and the circular cylinder of the rod passes through said rectangular groove of the rotation disc, the circular aperture, the elongate aperture of the displacement disc, and the elongate notch of the horizontal portion of the right side bracket; a lower disc provided in the base below the horizontal portion of the right side bracket for fixing said rod of the operation disc the arrangement being such that;

when the combination dials are rotated into the on-combination position, the flat portion of each sleeve faces upwards, the look can be opened by rotating the operation disc such that the arrow directs to the right and then by pulling the operation disc to the right; when the operation disc is rotated such that the arrow directs to the left, the right side bracket can be pushed to the left by pushing the operation disc to the left, thereby, each collar protruding beyond the right side of the corresponding dial is pushed to the left, and each sleeve is pushed to the left and disengaged from the corresponding dial to achieve the combination-changeable state.

* * * * *